US005458372A

United States Patent [19]

Goode

[11] Patent Number: 5,458,372

[45] Date of Patent: Oct. 17, 1995

[54] COMPOSITE SKI POLE & METHOD OF MAKING SAME

[76] Inventor: David P. Goode, 1997 Long Lake Shores Dr., Bloomfield Hills, Mich. 48013

[21] Appl. No.: 159,414

[22] Filed: Nov. 29, 1993

Related U.S. Application Data

[63] Continuation of Ser. No. 826,734, Jan. 28, 1992, Pat. No. 5,265,911, which is a continuation-in-part of Ser. No. 562, 317, Aug. 3, 1990, abandoned, which is a continuation-in-part of Ser. No. 448,306, Dec. 11, 1989, abandoned, which is a continuation-in-part of Ser. No. 296,222, Jan. 12, 1989, Pat. No. 5,024,866.

[51] Int. Cl.[6] ..... A63C 11/22

[52] U.S. Cl. ..... 280/819

[58] Field of Search ..... 280/819, 610

[56] References Cited

U.S. PATENT DOCUMENTS 4,301,201 11/1981 Stout ..... 280/819

4,679,813 7/1987 Girard ..... 280/602

FOREIGN PATENT DOCUMENTS 2605581 8/1976 Germany ..... 280/819

*Primary Examiner*—Eric D. Culbreth

*Attorney, Agent, or Firm*—Young, MacFarlane & Wood

[57] ABSTRACT

A lightweight, flexible ski pole which is virtually indestructible comprises a filament-reinforced, polymeric matrix composite shaft having a diameter of less than 0.5 inches and a tensile strength on the order of 140,000 psi or higher. The shaft is of three-layer construction, having a center layer whose filaments are diagonally offset at a bias angle for lateral bending strength. The shaft may be hollow or solid, and may be formed by either a pultrusion or table-rolling method.

8 Claims, 5 Drawing Sheets

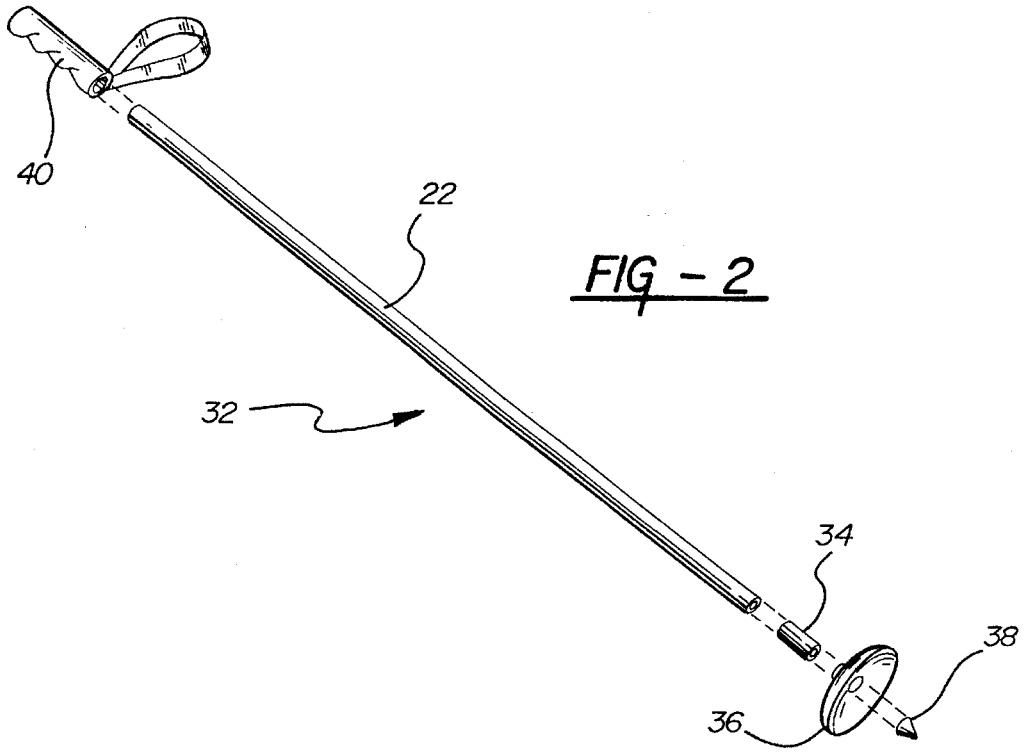
FIG - 2
FIG - 7
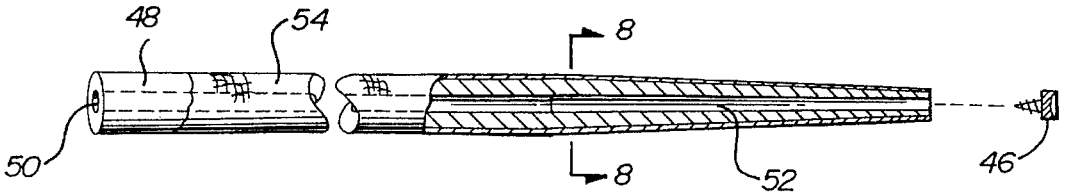
FIG - 8
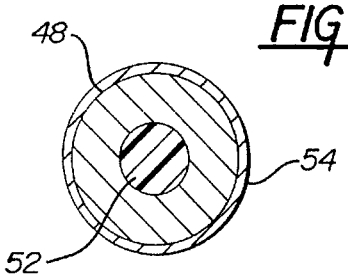
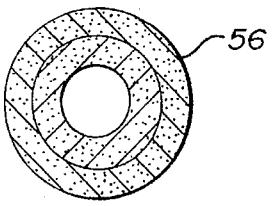
FIG - 10
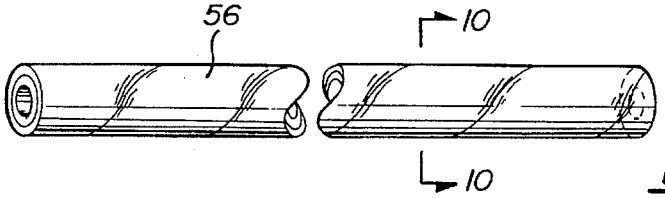
FIG - 9

FIG - 16
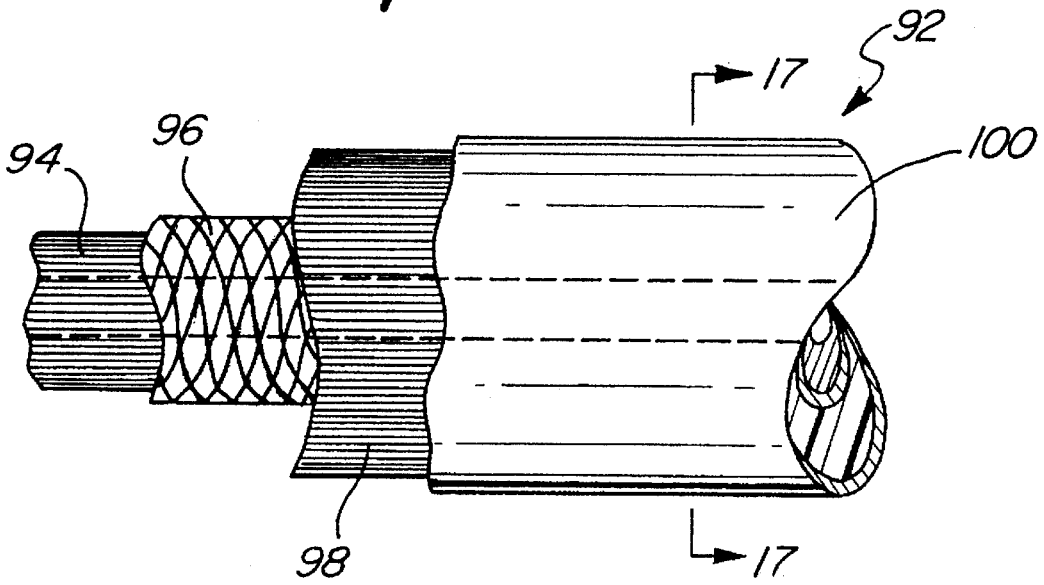
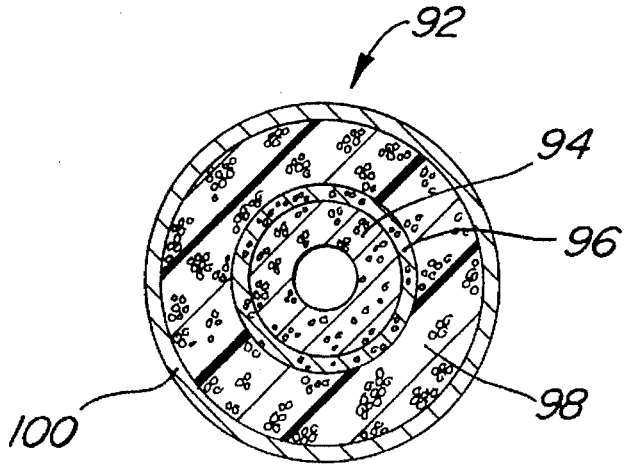
FIG - 17

COMPOSITE SKI POLE & METHOD OF MAKING SAME

RELATED APPLICATIONS

This application is a continuation of Ser. No. 826,734 filed Jan. 28, 1992, now U.S. Pat. No. 5,265,911 which is a continuation-in-part of U.S. patent application Ser. No. 562,317 filed Aug. 3, 1990, (now abandoned) which is a continuation-in-part of U.S. patent application Ser. No. 448,306 filed Dec. 11, 1989 (now abandoned), which is a continuation-in-part of U.S. patent application Ser. No. 296,222 filed Jan. 12, 1989, now U.S. Pat. No. 5,024,866 issued Jun. 18, 1991.

FIELD OF THE INVENTION

The present invention relates to ski poles and in particular to ski poles having shafts comprising filament/polymer composite construction.

BACKGROUND OF THE INVENTION

The standard state-of-the-art ski pole for the past two or three decades comprises a hollow, tapered aluminum shaft, painted with enamel, having a basket and tip mounted on one end and a hand grip mounted on the other end. Such a pole weighs about 6.5 ounces and has a tensile strength of about 50,000 psi.

The principal disadvantage of the traditional aluminum ski pole is that the shaft is relatively easy to bend; i.e., the aluminum shaft is soft and tends to permanently deform or even collapse under the bending loads commonly encountered during skiing. A partially collapsed shaft exhibits greatly reduced bending resistance and cannot be restored to its original shape and strength. Moreover, the paint is relatively easily chipped off and the resulting exposure of bare aluminum is unsightly.

Another disadvantage of the aluminum shaft is its axial rigidity and inability to absorb shock loads. To compensate for this, one recently introduced pole includes an expensive axial shock absorber near the hand grip.

U.S. Pat. No. 4,301,201 issued in 1981 to Stout discloses a filament/resin composite ski pole comprising an annular array of continuous reinforcing filaments or fibers embedded in a synthetic resin matrix and formed into a hollow tubular shaft by the process known as pultrusion. The filaments extend rectilinearly along the length of the shaft.

SUMMARY OF THE INVENTION

In accordance with my invention, an extraordinarily strong, flexible and shock absorbing, relatively light weight and aesthetically appealing ski pole is provided which overcomes the performance disadvantages of prior art aluminum and composite ski poles. In general, my ski pole comprises a shaft of filaments or fibers of aramid, carbon, glass or the like in a polymeric matrix, a weight of between about 3.5 and 9.3 ounces (in 48 inch length), a diameter of only about 0.5 to 0.25 inches and a tensile strength of about 140,000 psi or higher. With this physical combination, I have been able to achieve a commercial quality ski pole which is not only aesthetically appealing and modern in appearance, but which effectively absorbs shock loads through moderate, controlled bending, and is virtually indestructible in use; i.e., even deliberate efforts to break poles which I have constructed fail due to the extraordinary tensile strength.

Moreover, I have virtually eliminated the tendency of longitudinal-fiber poles to splinter near the surface when bent by treating the surface of my pole by acrylic enamel painting or polyester veiling.

I have achieved the objectives of my invention in several different constructions, all disclosed herein. Such constructions include solid poles, hollow poles, tapered poles, non-tapered poles, filled core poles and partially-filled hollow poles as hereinafter described.

In all forms, the subject ski pole shaft is extremely strong, flexible, relatively lightweight, susceptible of mass production, and generally exhibits a more slender, streamlined appearance than prior art ski poles; i.e., it is preferably on the order of 0.25 to 0.50 inches in diameter and may be attractively finished not only with paint but also with screened-on patterns, logos and the like. The reinforcing filaments can comprise glass, carbon, or aramid fibers, for example, or any combination thereof, depending on the desired stiffness of the ski pole. At least some of the filaments run rectilinearly along the length of the shaft. The anti-splinter material is preferably a quick-drying acrylic enamel, but may also include a polyester veil wrapped around the filaments within the polymeric matrix.

In a first embodiment of the invention, the shaft comprises a filament-reinforced polymeric matrix hollow outer shaft integrally pultruded about a core member. The core member extends substantially along the entire length of the hollow outer shaft to strengthen the hollow outer shaft without adding excessive weight thereto. The core member may comprise a length of solid foam having suitable compression and weight characteristics, or alternately an extruded thermoplastic material, or almost any suitable substance such as wood or the same material which the filaments comprise. A layer of anti-splinter material surrounds the filaments to prevent filament splinters from protruding from the outer surface of the shaft. The shaft is a cylindrical, non-tapered pole approximately 0.40 inches in diameter. A basket adapter, basket, tip and grip are adhesively or frictionally attached to the shaft to make a finished ski pole.

A second embodiment of my invention comprises a solid fiber/polymer shaft of about 0.5 inches nominal diameter, but tapering over the last 15 inches or so to about ⅜ inch. Fiber to polymer ratio is about 4:1, weighs about 9.3 ounces per 48 inch length and exhibits a tensile strength of 144,000 psi. The shaft is finished by dip coating in fast-drying acrylic enamel. The small-diameter end is drilled to accept an adhesively bonded-in tip insert. The taper can be achieved by milling.

A third embodiment is similar dimensionally to the second embodiment, but is hollow, wall thickness being about ⅛ inch. I reinforce and strengthen the tapered section by bonding in a ¼ inch diameter solid rod which may be a composite, solid resin, wood dowel or other material. This embodiment weighs only about 7.5 ounces per 48 inch length and exhibits a tensile strength of about 140,000 psi.

A fourth embodiment which is very light in weight (about3.7 ounces per 48 inch length) and very small in diameter (about ¼ inch, comprises a hollow shaft in which the inside composite layer has longitudinally arranged fibers and the outside layer has spirally wrapped fibers at an angle of about 45°.

A fifth embodiment of my invention comprises a hollow shaft having an outer diameter of about 0.40 inches and an inner diameter of 0.22 inches resulting in a wall thickness of approximately 0.09 inches. The shaft is comprised of three layers. An inner layer of rectilinear fibers, along the longitudinal axis of the shaft, a central layer of helically wrapped fibers arranged about the inner layer and an outer layer of rectilinear fibers arranged longitudinally over the center layer. Further, this embodiment may also comprise a solid shaft which may be tapered over the last 15 or so inches. Again, the taper can be achieved by milling.

A sixth embodiment is similar dimensionally to the previous embodiments and includes a sleeve mounted over the lower end of the shaft to prevent the tip of the pole from splintering.

A seventh and preferred embodiment of my invention comprises a ski pole shaft having an outer diameter less than ½ half inch and a tensile strength on the order of 290,000 psi. The shaft is comprised of three layers. An inner layer of rectilinear fibers aligned with the longitudinal axis of the shaft, a center layer of fibers arranged about the inner layer and offset from the longitudinal axis of the shaft at a specified angle for lateral or "hoop" strength, and an outer layer of rectilinear fibers arranged longitudinally over the center layer. In one embodiment, the shaft is hollow and has an outer diameter in a range of approximately 0.40 to 0.45 inches and an inner diameter of approximately 0.22 inches resulting in a wall thickness in a range of approximately 0.09 to 0.14 inches.

In a most preferred form of the seventh embodiment, the fibers of the center layer are arranged in a dual-opposed diagonal lattice angled approximately 45° to 65° from the longitudinal axis of the shaft. In a further embodiment of the invention, the outer layer comprises approximately ½ or more of the wall thickness of the ski pole shaft.

The polymer material used in any of the above disclosed embodiments can be either a thermoset polymer or a thermoplastic polymer. Each material providing the necessary bonding characteristics required to develop a strong, lightweight ski pole.

According to a second aspect of my invention, a method for making the ski pole shaft comprises the steps of pultruding an array of continuous reinforcing filaments through coating station which coats the array with a fluid polymeric material. The polymeric material is then hardened to form a continuous ski pole shaft. The continuously pultruded ski pole shaft is cut into suitable lengths. The ski pole shaft lengths are then fitted with a basket adapter, a basket, a tip and a grip to make a finished pole. The method may further include placing a polymer coated, anti-splinter means about the filaments prior to the hardening step.

In the first embodiment the method of making the ski pole shaft comprises the steps of pultruding an array of continuous reinforcing filaments through a bath of a thermosetting polymeric material, and further pultruding the filaments and polymeric material through a thermosetting die to form a continuously pultruded ski pole shaft which is then cut into suitable lengths. The method may also include coating an anti-splinter means, such as a polyester veil, with the thermosetting polymeric material and pultruding both the anti-splinter means and the reinforcing filaments through the thermosetting die. Additionally, the reinforcing fibers may be provided about a core member made of almost any suitable material.

A second embodiment of the method for making a ski pole shaft comprises pultruding an array of continuous reinforcing fibers into a forming die. A fluid thermoplastic polymer is injected into the forming die. The thermoplastic polymer is hardened within the forming die resulting in a continuously pultruded ski pole shaft which is then cut into suitable lengths. The method may also include an anti-splinter means, such as a polyester veil, inserted with the reinforcing filaments into the forming die prior to the injection of the fluid thermoplastic polymer. Additionally, the anti-splinter means may be added after the ski pole shaft is formed.

In a third embodiment of the method invention, the shaft comprises a filament-reinforced polymeric matrix composite solid pultruded body with a layer of fast drying acrylic enamel applied after forming a taper over one end portion. The shaft is a cylindrical with a nominal diameter of approximately 0.50 inches tapering over the final 15 inches or so to about ⅜ inch. A small bonded-in metal tip is placed in the tapered end of the shaft. A hand grip and a basket are frictionally and/or adhesively attached thereto to make a finished ski pole.

In a fourth embodiment of the method invention, the preferred method for forming the ski pole shaft of the seventh embodiment, the shaft is manufactured according to a table rolling method. In the table rolling method, the various fiber layers of the ski pole shaft are formed as resin-impregnated sheets and are wrapped about a mandrel. While still on the mandrel, the shaft is wrapped with a heat-shrink tape or sheet and subsequently heat cured to harden the resin binding the fibers. The heat-shrink tape applies pressure during the curing process to ensure that the fibers of the various layers are tightly bound into the resin matrix.

The mandrel is removed, the tape is removed, and the outer surface of the ski pole shaft is finished with the anti-splinter material as in the other embodiments.

BRIEF DESCRIPTION OF THE DRAWINGS

FIG. 2 is a perspective, exploded view of a finished ski pole;

FIG. 7 is a side view of still another embodiment which is tapered, hollow and partially filled;

FIG. 8 is a cross section of the FIG. 7 pole;

FIG. 9 is a side view of still another hollow, non-tapered embodiment;

FIG. 10 is a cross section of the FIG. 9 pole;

FIG. 16 is a fragmentary side view of an alternate embodiment of a hollow three-layer pole; and FIG. 17 is a cross-section view taken on line 16—16.

DETAILED DESCRIPTION OF THE ILLUSTRATED EMBODIMENT

Figure 1:
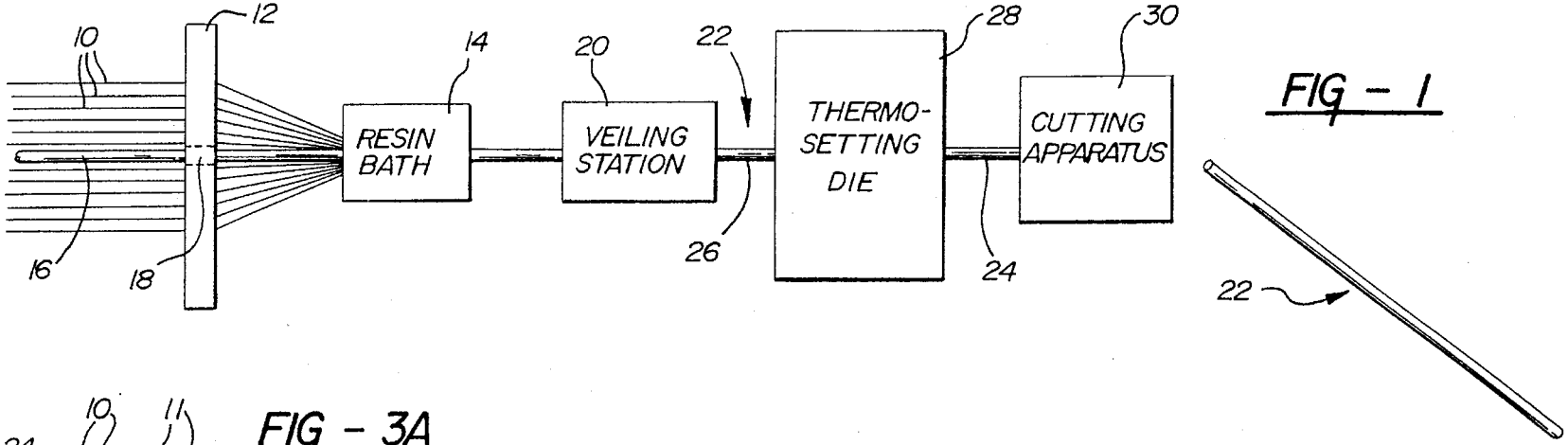
FIG. 1 is a schematic view of a method for forming a ski pole shaft according to a first embodiment of the present invention.

Referring now to FIG. 1, the process for making a ski pole shaft according to a first embodiment of the present invention is shown in schematic form. An array of continuous reinforcing elements 10 is pultruded from a suitable filament supply (not shown). Filaments 10 may comprise glass, carbon, or aramid filaments, for example, or the array may comprise a combination of different filaments. One group of aramid fibers having utility in the present invention are those aramid fibers sold by the DuPont Corporation under the trademark Kevlar®. The array of filaments 10 is pultruded through a suitable guide member 12, which channels the filaments into a resin bath 14 containing a thermosetting polymer in liquid form.

Prior to the entrance to the thermosetting polymer bath 14, a continuous solid foam core member 16 is extruded from a conventional extruding apparatus (not shown) through a suitable aperture 18 in guide member 12 and into the array of filaments 10, such that when core member 16 enters the thermosetting polymer bath 14 it is intimately surrounded by filaments 10. Together filaments 10 and core member 16 are pultruded/extruded through the thermosetting polymer bath 14, causing the filaments 10 and the core member 16 to becoming thoroughly coated with the thermosetting polymer.

In an alternate embodiment, core member 16 may comprise an extruded thermoplastic core. In fact, core member 16 may comprise almost any suitable material including the same material used for filaments 10.

To prevent splinters of filaments 10 from protruding from the thermosetting polymeric matrix outer surface of the finished ski pole shaft 22, creating the potential for injury to the hands of someone holding or carrying the ski pole, polymeric coated filaments 10 are provided with a thin polyester veil 26 at veiling station 20 prior to thermosetting die 28. Polyester veil 26 comprises a sheet or veil of a suitable polyester wrapped or wound around filaments 10 on core member 16. Polyester veil 26 is typically perforated to permit the liquid polymeric matrix on filaments 10 and core member 16 to flow through and over the veil, covering it completely. If desired, veil 26 may first be dipped in a different polymeric material before being applied to filaments 10.

Core member 16, polymer-coated filaments 10 and polyester veil 26 are then further pultruded into and through a heated thermosetting die 28 to set the liquid thermosetting polymer and define the final cylindrical, non-tapered shape of ski pole shaft 22. The continuous ski pole shaft 22 emerging from die 28 now comprises a thermosetting polymeric matrix, filament-reinforced hollow outer shaft portion 24 integrally pultruded about core member 16. The outer surface of ski pole shaft 22 is a smooth polymer, anti-splinter polyester veil 26 completely embedded within the polymeric matrix immediately adjacent filaments 10. The continuously pultruded ski pole shaft 22 is then cut by a cutting apparatus 30 into lengths suitable for use as ski poles.

Painting of ski pole shaft 22 can be eliminated by pre-coloring the thermosetting polymer in the bath 14 so that the shaft 22 coming from thermosetting die 28 already has its final color. If desired, a logo or design can be applied to the shaft 22 while it is still continuous, i.e. between thermosetting die 28 and cutting apparatus 30. A logo or design can also be applied to polyester veil 26 and the color of the thermosetting polymer chosen so that the logo or design is visible through the layer of set resin covering the veil 26. The non-tapered continuously-pultruded ski pole shaft 22 requires almost no additional work once it has been cut to length: the final shape and color of shaft 22 are already set; no assembly or insertion of core member 16 into ski pole shaft 22 is needed, since core member 16 has already been continuously integrally formed with ski pole shaft 22; and the smooth, splinter-free outer surface of ski pole shaft 22 requires no smoothing or finishing operations.

Still referring to FIG. 1, the process for making a ski pole shaft according to a third embodiment of the invention is essentially the same as the process for the first embodiment except that the step of feeding core member 16 into the array of filaments 10 prior to entering the thermosetting polymer bath 14 is omitted. The array of filaments 10 is pultruded through guide member 12, which channels the filaments into thermosetting polymer bath 14, thoroughly coating the filaments 10 with the thermosetting polymeric material. The coated filaments 10 are provided with a polyester veil 26 in the same manner disclosed for making the first embodiment of the invention. Polymeric coated filaments 10 and polyester veil 26 are then further pultruded into and through heated thermosetting die 28 to set the thermosetting polymeric material and define the final cylindrical, non-tapered shape of ski pole shaft 22. The continuous ski pole shaft 22, emerging from die 28, comprises a thermosetting polymeric matrix filament-reinforced solid shaft. The outer surface of the solid shaft is a smooth, anti-splinter polyester veil 26 completely embedded within the polymeric matrix immediately adjacent filaments 10. The continuously pultruded solid ski pole shaft 22 is then cut by a cutting apparatus 30 into lengths suitable for use as ski poles. The shaft 22 is finished in the same manner as the hollow outer shaft/core ski pole shaft of the first embodiment of the invention.

Since there is no core member in the solid pultruded ski pole shaft of the second embodiment, the polymeric matrix will be substantially continuous throughout the shaft body, interrupted only by filaments 10 and polyester veil 26. The solid ski pole shaft of this second embodiment can also typically be made thinner than the first embodiment having a core member.

The ski pole shafts of the first and third embodiments are preferably non-tapered to eliminate additional manufacturing steps and to give them a distinctive appearance over the prior art ski poles. In some instances it may be desirable to taper the shaft. Tapering of the shaft is easily effected by introducing an intermittent tapering step, such as an intermittent tapering die or milling operation into the process shown in FIG. 1.

Figure 1A:
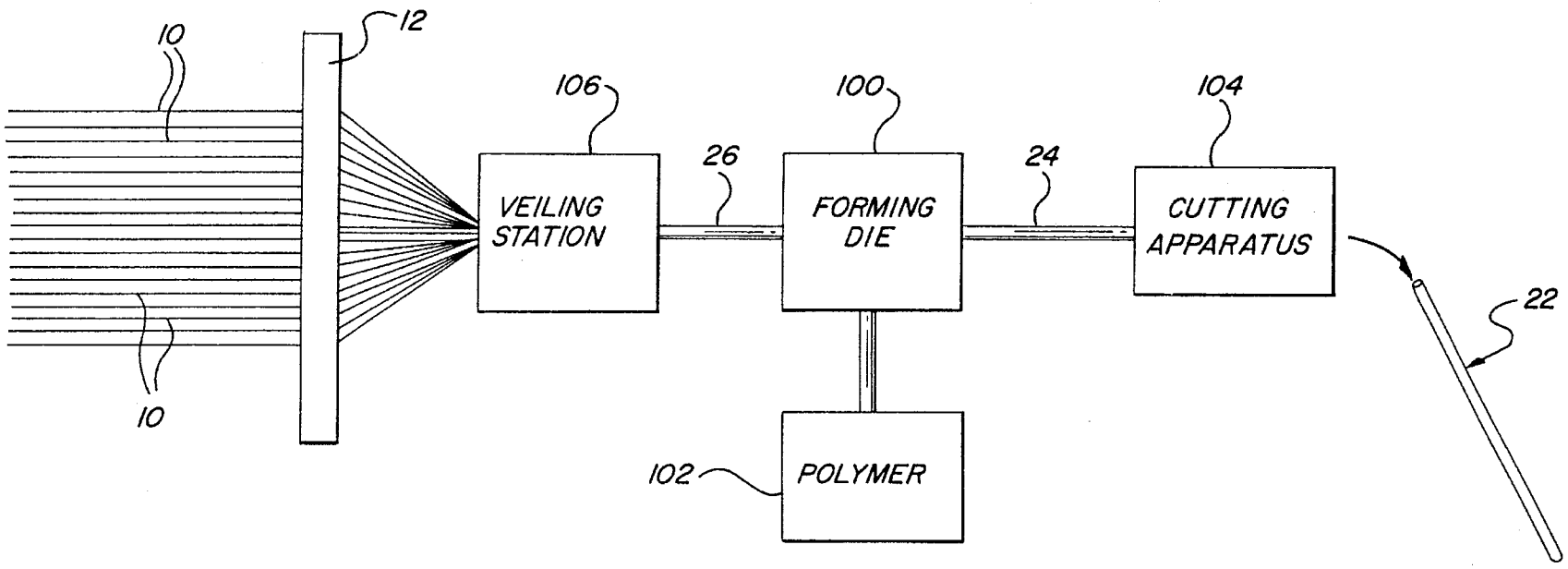
FIG. 1*a* is a schematic view of a method for forming a ski pole shaft according to a second embodiment of the present invention.

Referring now to FIG. 1*a*, the process for making a ski pole according to the second embodiment is shown in schematic form. An array of continuous reinforcing elements 10 is again pultruded from a suitable filament supply. As previously indicated, the filaments may comprise glass, carbon, aramid or any other filament material, including any combination of filament materials. The array of filaments 10 is pultruded through a suitable guide member 12, which channels the filaments 10 into a forming die 100. A thermoplastic polymeric material 102 is heated to a liquid state and is injected into the forming die 100. The thermoplastic polymeric material 102 when injected into the forming die 100 coats and surrounds the filaments 10. The thermoplastic polymeric material is cooled and hardened within the forming die 100 forming a continuously pultruded ski pole shaft 22 which is then cut into lengths suitable for use as ski poles by a cutting apparatus 104.

An anti-splinter means, such as a polyester veil, may be added to the filaments 10 at a veiling station 106 prior to entering the forming die 100. As previously described, a logo or design may be applied to the veil and the thermoplastic polymeric material chosen so that the design or logo is visible through the thermoplastic polymeric material.

The shaft of the second embodiment may be easily tapered through a secondary forming operation. A tapering step may be introduced to the manufacturing process, wherein the ski pole shaft is placed in a heated forming die, which re-heats the thermoplastic polymeric material, allowing a taper to be formed on the end of the ski pole shaft. This reforming process is particularly advantageous when used with shafts of hollow construction as the material at the end of the shaft is compressed into the hollow center of the shaft during the reforming process. This reforming process results in a concentration of material at the end of the ski pole shaft, resulting in a uniform strength throughout the length of the shaft, as opposed to milling the shaft to achieve the taper, which causes a reduction in strength at the pole tip as a result of material loss.

Further, a step may be added to the second embodiment whereby the ski pole shaft may be reformed in a curved or bent fashion suitable for use as a high performance ski pole, such as those used for competitive ski racing. The thermoplastic polymeric material allows the pole shaft to be formed in any shape desired by each individual skier.

Referring now to FIG. 2, a finished ski pole 32 comprising ski pole shaft 22, basket adapter 34, basket 36, tip 38 and hand grip 40 is shown in an exploded view. Adapter 34 is adhesively bonded to shaft 22 near the arbitrarily chosen lower end of ski pole 22, basket 36 is next adhesively or frictionally mounted on adapter 34, and tip 38 is adhesively bonded to the lower end of shaft 22. Hand grip 40 can be adhesively or frictionally mounted on the opposite or upper end of shaft 22 to complete ski pole 22.

Figure 4:
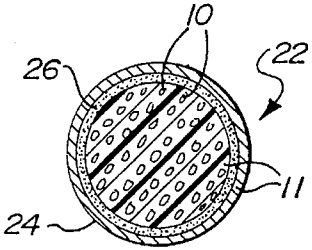
FIGS. 3*a*, 3*b* and 4 are cross-sectional end views of first, first alternate and second embodiments of a ski pole shaft according to the present invention.
Figure 3A:
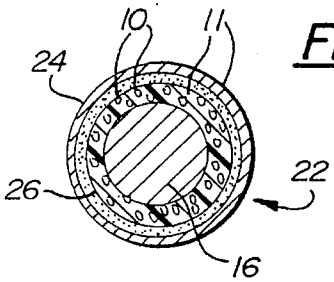
Figure 3B:
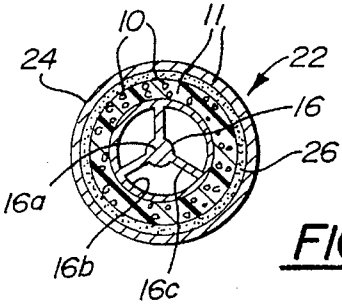

Referring to FIGS. 3*a*, 3*b* and 4, the core structures of the first, first alternate and second embodiments of ski pole shaft 22 can be seen in cross-section.

In FIG. 3*a*, hollow outer shaft 24 comprising reinforcing filaments 10 embedded in polymeric matrix 11 has been integrally pultruded about core member 16, such that no separate assembly or bonding step is required to engage and maintain the two elements in a tight integral fit. Core member 16 comprises solid molded or extruded foam extending longitudinally along the entire length of hollow outer shaft 24. The lightweight, integrally pultruded foam core member 16 resiliently strengthens composite hollow outer shaft 24 enough to provide adequate support for a skier, and to resist crushing of the ski pole shaft, without making the ski pole excessively heavy.

In FIG. 3*b* , hollow outer shaft 24 comprising reinforcing filaments 10 embedded in a polymeric matrix 11 has been integrally pultruded about thermoplastic core member 16, such that no separate assembly or bonding step is required to engage and maintain the two elements in a tight, integral fit. Thermoplastic core member 16 comprises a longitudinal center rib 16*a* coaxial with and extending longitudinally along the entire length of hollow outer shaft 24, an annular outer wall portion 16*b* corresponding substantially to the inside diameter of hollow outer shaft 24, and a plurality of radially extending ribs 16*c* joining longitudinal rib 16*a*and annular wall 16*b*. Thermoplastic core member 16 strengthens shaft 22 in the same lightweight, flexible manner as foam core member 16 in FIG. 3*a*.

In FIG. 4, solid pultruded ski pole shaft 22 comprises an array of reinforcing filaments 10 embedded in polymeric matrix 11.

In all of the illustrated embodiments of FIGS. 3*a*, 3*b* and 4, ski pole shaft 22 is extremely tolerant of bending loads, i.e. even after severe bending ski pole shaft 22 simply returns to its normal straight orientation as soon as the bending load is removed. During severe bending, however, it is not uncommon for some of reinforcing elements 10 to break. While this breakage does not noticeably affect the overall performance of ski pole shaft 22, fine splinters of filaments 10 can protrude from the polymeric matrix outer surface of shaft 22, creating a splinter hazard to the hands of the person using the pole. To prevent this, polyester veil 26 is wrapped or wound around filaments 10 in all of the illustrated embodiments to keep the outer surface of ski pole shaft 22 smooth, and free of filament splinters which might otherwise protrude.

Figure 5:
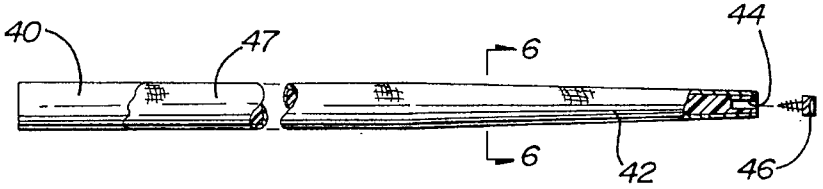
FIG. 5 is a side view of a solid, tapered embodiment of my invention.
Figure 6:
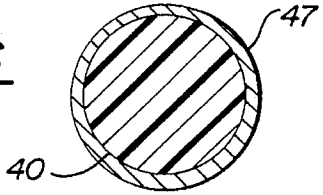
FIG. 6 is a cross section of the FIG. 5 pole.

FIGS. 5 and 6 illustrates a further embodiment of the invention in the form of a filament/polymer ski pole shaft 40 which is manufactured in solid form, approximately 79% filament by weight and 21% polymer by weight for a filament to polymer ratio of approximately 4:1. The nominal diameter of pole shaft 40 is ½ inch but the distal portion 42 is milled after manufacture to produce a uniform taper over a length of approximately 15 inches to a diameter of approximately ⅜ inch. The tapered end is drilled out to produce a cavity 44 of about ¾ of an inch in length to receive a cadmium plated hardened steel tip 46. The tip has a slightly hollowed end surface and is bonded in place with an epoxy adhesive.

Shaft 40 weighs approximately 9.3 ounces per 48 inch length and exhibits a tensile strength of approximately 144,000 psi. As such it is virtually indestructible in ordinary use; i.e., it will withstand extreme bending loads without fracture and will, after the loads are removed, return to its original straight configuration. Bending under such loads is totally elastic and appears to produce no deleterious effects whatsoever. Moreover, in this diameter and strength combination, pole 40 exhibits enough resilience to comfortably absorb shock loads which are incurred in normal and even fast pace competitive skiing thereby eliminating the need for a special axial shock absorber as hereinbefore mentioned. After milling but before the installation of the hardened steel tip 46 and the other normal accessories; i.e., basket and handgrip, pole 40 is dip-coated in a fast drying acrylic paint such as that which is currently available from the Sherwin Williams Co. It is especially convenient to match the resin color to the paint color so that even damage to the pole surface which is severe enough to remove some paint produces no unsightly exposure of underlying material such as is often the case with painted aluminum poles. The acrylic paint is sufficiently flexible to withstand the flexing and bending of the pole shaft 40 without shipping, breaking or fracturing at the surface. Moreover, the paint acts as a veil to prevent the exposure of fractured filament ends.

FIGS. 7 and 8 illustrates a still further embodiment which is in the form of a ski pole shaft 48 which is essentially dimensionally similar to the pole shaft 40 of FIG. 5; i.e., nominal diameter is ½ inch and the pole is milled after forming over the distal 15 or so inches to produce a taper to a final or end diameter of approximately ⅜ of an inch. However, pole 48 is formed with a continuous interior hollow 50 thereby to exhibit a wall thickness of approximately ⅛ inch. In this configuration I have found that the tapered ends, because of the reduced wall thickness, is subject to crushing under lateral compression load and to compensate for this tendency I adhesively bond into the hollow, a ¼ inch diameter solid reinforcing rod filler 52.

Thereafter I bond in the tip 46 which is identical to that utilized in the embodiment of FIG. 5. Finally, I dip-coat the pole 48 in fast-drying acrylic enamel to produce an aesthetically pleasing and protective paint surface 54. The paint surfaces of both poles 40 and 48 are capable of receiving screened-on patterns such as graphics, logos, personalizations and the like. Basket and handgrip are thereafter adhesively/frictionally applied in the fashion previously described.

The pole shaft 48 in a 48 inch length weighs approximately 7.5 ounces and, because of the hollow interior, is lighter than the pole shaft 40 of FIG. 5. However, I have been able to achieve tensile strengths of 140,000 psi or better with fiber-to-polymer ratios of approximately 4:1; 79% by weight fiber and 21% by weight polymer. Accordingly, even though the pole shaft 48 is significantly lighter than the pole shaft 40, there is no significant reduction in tensile strength and the consequential ability of the pole shaft to withstand extreme bending loads. Again, I have found that in normal use the pole shaft 48 is virtually indestructible. The reinforcing rod may be wood, but is preferably a polymeric material and is adhesively bonded in place.

An extremely lightweight pole shaft 56 suitable for use in fabricating lightweight, high performance ski poles is illustrated in FIGS. 9 and 10. Pole shaft 56 is of uniform diameter over its length; i.e. it is not tapered and may be manufactured in diameters on the order of ¼ to ⅜ of an inch. Accordingly, the pole shaft 56 produces a ski pole which is very modern and contemporary in appearance, yet, manufactured as hereinafter described, is essentially as capable of withstanding bending loads as the pole shafts 40 and 48 of FIGS. 5 and 7, respectively.

Pole shaft 56 is manufactured in two layers, the first layer comprising a 79% longitudinal filament and 21% polymer resin combination wherein the filaments are protruded and longitudinally arranged as is the case with all previously described embodiments. However, a spirally wrapped outer layer with a bias angle of approximately 45 is also provided. The interior of pole shaft 56 is hollow; wall thickness on the order of ⅛ of an inch. Weight for a 48 inch length is approximately 3.7 ounces. The shaft 56 is preferably manufactured utilizing carbon fibers commonly known as "graphite" and is also dip painted as hereinbefore described.

Figure 11:
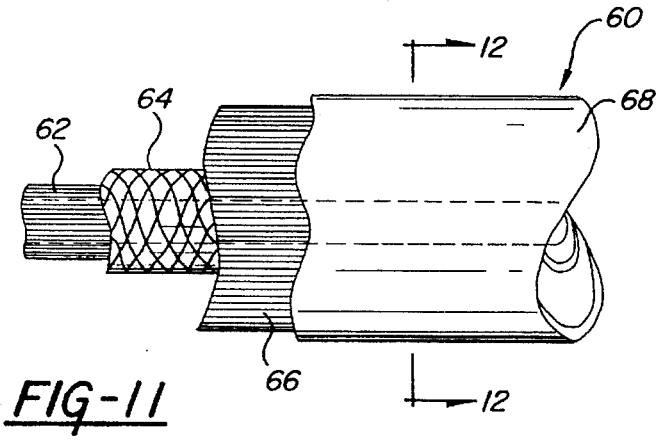
FIG. 11 is a fragmentary side view of another hollow embodiment.
Figure 12:
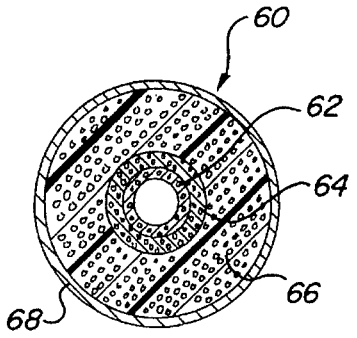
FIG. 12 is a cross section view taken on line 12—12.
Figure 13:
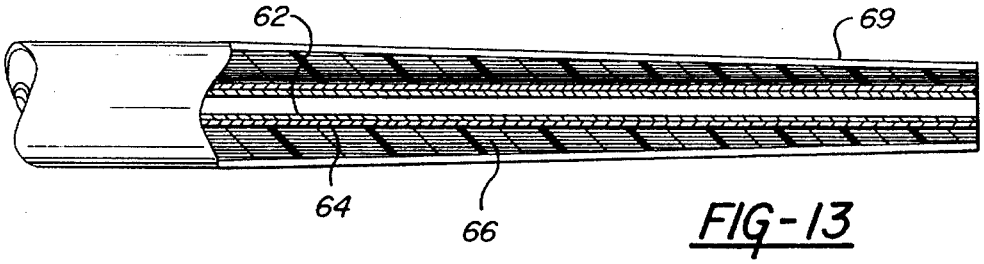
FIG. 13 is a fragmentary side view of another hollow tapered embodiment.

FIGS. 11 and 12 illustrate a further embodiment of a pole shaft fabricated utilizing a three layer construction. The pole shaft 60 is comprised of a first layer 62 of polymer coated fibers rectilinearly arranged about the central, longitudinal axis of the shaft, a center layer 64 of polymer coated fibers wrapped or wound about the inner layer 62 in a helical manner, and an outer layer 66 of rectilinearly arranged polymer coated fibers laid over the center layer 64. The outer layer 66 makes up approximately ⅔ of the radial thickness of the pole shaft 60. Placed over the outer layer 66 is a smooth, polymer-rich, anti-splinter polyester veil 68 which provides a smooth splinter-free exterior surface, eliminating any further finishing operations. Further, as previously described, the pole shaft 60 may be dip coated in fast drying acrylic paint wherein the paint itself acts as a veil.

The above-disclosed pole design is of a hollow construction and is pultruded about a floating mandrel. In the illustrated embodiment, the fibers are helically wound about inner layer 62 in a dual-opposed fashion; e.g., two sets of fibers are wound in opposite directions along the length of the shaft. This dual-opposed winding provides greater lateral or "hoop" strength then a single unidirectional winding, such that a pole having a diameter as small as 10.4 mm (0.40 inches) exhibits a tensile strength on the order of 290,000 psi. The ski pole shaft of this embodiment is also extremely lightweight, as a result of hollow, tubular construction. The pole shaft 60 has an outer diameter on the order of 10.4 mm. and an inner diameter of 6 mm., resulting in a total wall thickness of 2.2 mm. The shaft is preferably manufactured utilizing carbon fibers commonly known as "graphite." Combining high-tensile strength with light weight results in a virtually indestructible high performance ski pole for use by skiers of all skill levels.

The composite construction of the pole shaft 60 as shown in FIGS. 11 and 12 and described above, is also compatible with a tapered pole construction. Referring to FIG. 3, the taper may be achieved by milling, which removes approximately 75% of the outside layer 66 only. The tapered pole may then be dip coated in an acrylic paint 69 to provide a smooth, splinter-free exterior surface which eliminates the need for further smoothing or finishing operations.

Figure 14:
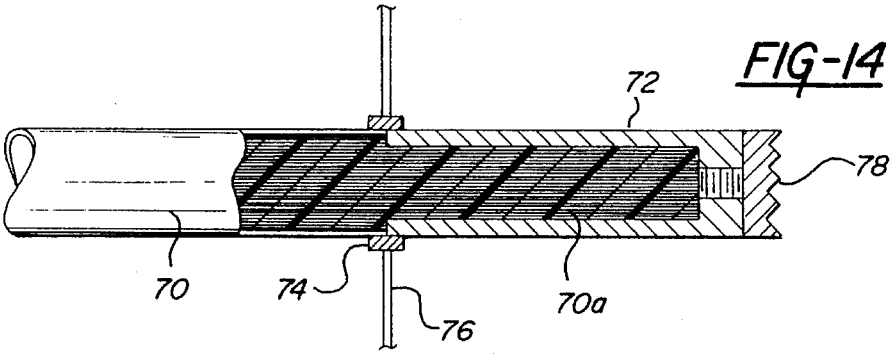
FIG. 14 is a side view of an additional embodiment.
Figure 15:
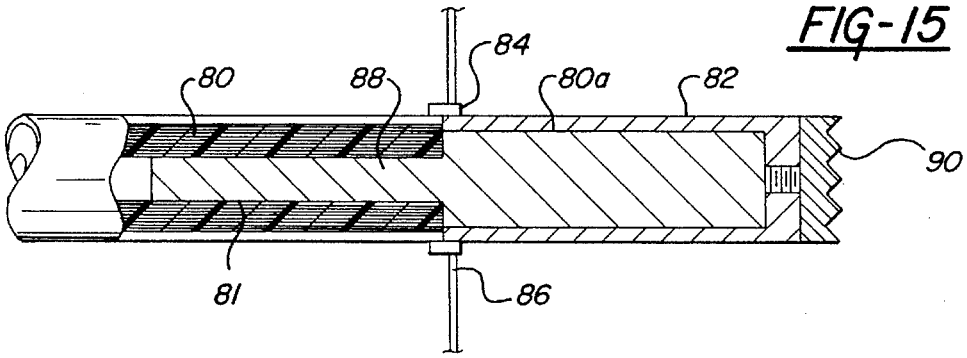
FIG. 15 is a hollow tapered pole utilizing an embodiment similar to FIG. 14.

FIGS. 14 and 15 show a further embodiment of a pole shaft wherein a sleeve of a suitably rigid material is placed over the lower end of the pole to prevent splintering of the pole tip. FIG. 14 shows a pole 70 milled to a constant diameter section **70*a* to accommodate an aluminum sleeve 72. A basket collet 74 fits over and covers the joint between the sleeve 72 and the pole 70. A basket member 76 is then attached to the basket collet. A hardened tip 78 fits into the end of the sleeve 72**.

Referring to FIG. 15, a hollow pole 80 may also be fitted with a sleeve 82 adjacent the end of the pole 80. A composite reinforcing rod 88 is press fit into an aluminum sleeve 82. The rod 88 is cemented into the hollow interior 81 of the pole 80. A basket collet 84 fits over and hides the joint between the aluminum sleeve 82 and the pole 80. A basket member 86 is mounted to the basket collet 84. Finally, a hardened steel tip 90 is mounted to the sleeve 82.

Both of the embodiments shown in FIGS. 14 and 15 and described above may be used with either solid or hollow tapered pole construction.

FIGS. 16 and 17 illustrate a further embodiment of a pole shaft fabricated utilizing a three layer construction wherein the fibers of the center layer, rather than being helically wound along the length of the shaft, are non-continuous and offset at a diagonal bias angle in crisscross fashion to achieve the same or greater strength as continuous wound fibers. The pole shaft 92 is comprised of a first layer 94 of polymer coated fibers rectilinearly arranged about the central, longitudinal axis of the shaft, a center layer 96 of polymer coated fibers wrapped about the inner layer 94 such that the fibers are set at a bias angle relative to the longitudinal axis of the shaft, and an outer layer 98 of rectilinearly arranged polymer coated fibers laid over the center layer 96. The polymer or matrix surrounding the fibers is a thermosetting epoxy resin in the illustrated embodiment, although it will be apparent to those skilled in the art that various thermosetting or thermoplastic polymers may be used.

The fibers of the inner and outer layers 94, 98 in the illustrated embodiment are carbon fibers, while the center layer 96 comprises glass fibers. This construction has been found to provide an optimum combination of strength, flexibility and economy of manufacture, although other combinations of glass, carbon and/or Kevlar-type fibers may be used. For example, all three layers could comprise carbon fibers.

Referring still to FIGS. 16 and 17, the thickness of the outer layer 98 should be at least approximately half the total wall thickness of shaft 92, the preferred range being approximately one half to approximately two thirds the total wall thickness of the shaft. The center layer 96 is preferably of only nominal thickness, such that inner layer 94 comprises the bulk of the remainder Of the wall thickness of the shaft.

Referring now to FIG. 16, it can be seen that the fibers of center layer 96 are arranged in a crisscross or dual-opposed lattice within the resin matrix. This construction results in greater strength than fibers aligned in a single direction. The bias or offset of the fibers of central layer 96 relative to the longitudinal axis 92 of the shaft is approximately 45° to 65°. In the illustrated embodiment, the fibers are offset approximately 65° from the shaft axis. This 45° to 65° range provides optimum lateral or "hoop" strength to the pole.

The above-described three layer shaft construction provides an exceptionally advantageous combination of high tensile strength and small diameter. The pole shaft 92 of the illustrated embodiment has an outer diameter on the order of 10.4 mm (approximately 0.40 inches) and an inner diameter of 6.0 mm (approximately 0.22 inches), resulting in a total wall thickness of 2.2 mm (approximately 0.09 inches). This shaft is extremely strong, exhibiting a tensile strength on the order of 290,000 psi. At the same time, it is light in weight at approximately 4.4 ounces, and its small diameter substantially decreases wind resistance while skiing, to the point that use of these poles has been found to significantly reduce racing times in competition.

Although the pole shaft 92 in the illustrated embodiment exhibits a preferred diameter of approximately 10.4 mm, the diameter can be made greater or smaller using this three-layer construction. However, the range which has been determined to provide an optimum combination of strength, light weight and low wind resistance is an outer diameter from approximately 10.4 mm to approximately 11.5 mm. The 10.4 mm pole is more than adequately rigid for most types of skiing, while poles of 11.0 mm and 11.5 mm have been found to provide added rigidity to the pole shaft 92 sometimes useful in exceptional skiing conditions; e.g., high speed competitive racing on very steep, icy slopes. All poles utilizing the above-described three layer construction and lying within the range of 10.4 to 11.5 mm exhibit tensile strengths on the order of 140,000 to 290,000 psi, depending on the fibers used. All are substantially less than one half inch in diameter, resulting in greatly reduced wind resistance over prior art poles, and weigh only approximately 4.4 to approximately 5.4 ounces.

Although the three layer pole design has been described above as having a hollow construction, it may also be of solid construction with an inner layer 94 being solid all the way through.

The three layer pole shaft 92 of FIGS. 16 and 17 is preferably formed using a table rolling method. Inner layer 94, comprising a pre-impregnated sheet of polymer coated fibers, is wrapped about a cylindrical metal mandrel. Next, center and outer layers 96, 98, also comprising sheets of polymer coated fibers, are wrapped over inner layer 94 on the mandrel. The resin/fiber sheets are appropriately cut so that an even layer of each is wound about the mandrel or previous layers to create the cylindrical pole shaft 92.

The resin used is preferably a thermosetting epoxy resin. Once all three layers have been wound about the mandrel and cut, the entire shaft is then overwrapped with a heat shrink tape. The overwrapped shaft is then heat cured, during which the heat tape shrinks to tightly bind one layer to the other and to bind the fibers within their respective layers. The cure time and heat used in the curing process is variable, depending on the thermosetting resin used, and will be apparent to those skilled in the art of thermosetting resins.

After the pole shaft 92 has been heat cured it is removed from the mandrel, cut to length if necessary, and the heat shrink tape is ground off. The finished pole shaft may then be provided with an anti-splinter layer 100. Any of my above-described inventive anti-splinter methods can be used: e.g., acrylic dip coating or polyester veiling.

All of the embodiments disclosed herein may be constructed of either a thermosetting polymeric material or a thermoplastic polymeric material. The thermoplastic polymeric material has advantages in that it may be easily reformed in secondary forming operation, thus eliminating the need to mill a pole shaft to provide a tapered section, which may require a reinforcing rod or shaft to prevent splintering of the pole tip.

The following thermoplastic polymeric materials are examples of the type of material which may be used in the construction of previously disclosed embodiments: acrylics; polyetheretherketone, polyolefins; thermoplastic polyamide, polyesters, acrylonitrile-butadiene-styrene, polycarbonate, polyethersulfone and the like. The following thermosetting polymeric materials are examples of the type of materials which may be used in the construction of the previously disclosed embodiments: phenolics, epoxies, urethanes, thermosetting polyimides and melamines. Applicant submits the above material lists are not exclusive and that other suitable polymeric materials may exist for use with applicant's disclosed embodiments.

It is to be understood that the foregoing illustrated embodiment is a description of a preferred embodiment in accordance with 35 U.S.C. 112, and is not intended to be limiting. For example, the method for making the filament/polymer composite outer shaft, non-composite inner core ski pole shaft of the first embodiment of the present invention is not limited to the process known as pultrusion, but may comprise any suitable method of continuously integrally forming a filament/polymer composite outer shaft about a core member and still lie within the scope of the invention. The core member may comprise materials other than solid foam or extruded thermoplastic, and may be of any almost suitable form which provides sufficient strength to the hollow outer shaft and allows it to bend without breaking. The reinforcing filaments or fibers in both embodiments of the shaft are not limited to glass, carbon, or aramid filaments, but may comprise other suitable materials. The basket adapter, basket, tip and grip may take any suitable form and may be fastened to the shaft in any number of ways. Also, polyester veil 26 may comprise other suitable veiling materials and may be applied to filaments 10 before or after polymer bath 14.

I claim:

1. A ski pole shaft of filament-resin construction, having a maximum diamter between 10.4 and 11.5 mm and a tensile strength on the order of 140,000 psi or higher, wherein the shaft comprises first, second and third layers, the filaments of the second layer offset with respect to filaments of the first and third layers, wherein the filaments of the first layer are arranged rectilinearly along the logitudinal axis of the shaft from end to end, the filaments of the second layer are arranged in dual-opposed fashion over the first layer at a bias angle with respect to the longitudinal axis of the shaft, and the filaments of the third layer are laid over the second layer and arranged rectilinearly along the longitudinal axis of the shaft, wherein the third layer has a thickness greater than the thickness of the first and second layers combined.

2. A ski pole shaft as defined in claim 1, wherein the shaft has a tensile strength on the order of 290,000 psi.

3. A lightweight, flexible, low wind-resistance ski pole shaft of filament-reinforced resin-matrix construction having a maximum diameter of less than ½ inch and a tensile strength on the order of 140,000 psi or higher, the shaft being hollow with a shaft wall comprising an outer layer of filaments arranged rectilinearly along the longitudinal axis of the shaft from end to end, a first inner layer adjacent the outer layer and having filaments offset with respect to the filaments of the outer layer, and a second inner layer adjacent the first inner layer whose filaments are arranged rectilinearly along the longitudinal axis of the shaft, wherein the outer layer has a thickness greater than that of the inner layers combined.

4. A ski pole shaft as defined in claim 3, wherein the filaments of the first inner layer are arranged in dual-opposed fashion at a bias angle with respect to the longitudinal axis of the shaft.

5. A ski pole shaft as defined in claim 4, wherein the shaft has a tensile strength on the order of 290,000 psi.

6. A ski pole shaft as defined in claim 3, wherein the outer diameter of the shaft lies between 10.4 and 11.5 millimeters.

7. A ski pole shaft as defined in claim 6, wherein the outer diameter of the shaft is approximately 10.4 millimeters, the inner diameter of the shaft is approximately 6.0 millimeters, and the shaft wall thickness is approximately 2.2 millimeters.

8. A ski pole shaft as defined in claim 3, wherein the thickness of the shaft wall comprises at least 20 percent of the diameter of the shaft.

* * * * *

UNITED STATES PATENT AND TRADEMARK OFFICE

CERTIFICATE OF CORRECTION

PATENT NO. : 5,458,372

DATED : October 17, 1995

INVENTOR(S) : Goode

It is certified that error appears in the above-indentified patent and that said Letters Patent is hereby corrected as shown below: On the title page: Item [54] and Column 1, line 1, , delete "Composite Ski Pole & Method of Making Same" and insert --Composite Ski Pole Shaft--.

Column 2, line 57, delete "about3.7" and insert --about 3.7--

Column 11, line 4, delete "Of" and insert --of--.

Signed and Sealed this

Seventh Day of January, 1997

*Attest:*

Bruce Lehman

BRUCE LEHMAN

*Attesting Officer*

*Commissioner of Patents and Trademarks*